US008443995B2

(12) United States Patent
Ungrady et al.

(10) Patent No.: US 8,443,995 B2
(45) Date of Patent: May 21, 2013

(54) HOT FILL TYPE PLASTIC CONTAINER

(75) Inventors: Eric B. Ungrady, Mt. Wolf, PA (US); Michael T. Kelly, Manchester, PA (US); Justin A. Howell, New Cumberland, PA (US); Raymond A. Pritchett, Jr., Manchester, PA (US)

(73) Assignee: Graham Packaging Company, L.P., York, PA (US)

( * ) Notice: Subject to any disclaimer, the term of this patent is extended or adjusted under 35 U.S.C. 154(b) by 147 days.

(21) Appl. No.: 12/940,264

(22) Filed: Nov. 5, 2010

(65) Prior Publication Data

US 2012/0111824 A1 May 10, 2012

(51) Int. Cl.
*B65D 1/46* (2006.01)

(52) U.S. Cl.
USPC ..... 215/381; 215/382; 220/669; 220/673; 220/675

(58) Field of Classification Search
USPC ..... 215/379–384, 900; 220/666, 669, 220/672, 671, 675
See application file for complete search history.

(56) References Cited

U.S. PATENT DOCUMENTS

| | | | | |
|---|---|---|---|---|
| D91,247 | S | 12/1933 | Mengle | |
| D108,796 | S | 12/1938 | Petty | |
| D163,148 | S | 5/1951 | Sterrett | |
| D253,809 | S | 1/1980 | Hartung | |
| 5,178,289 | A * | 1/1993 | Krishnakumar et al. | 215/382 |
| 5,217,737 | A * | 6/1993 | Gygax et al. | 426/111 |
| 5,238,129 | A * | 8/1993 | Ota | 215/381 |
| D365,638 | S | 12/1995 | Young | |
| 5,750,226 | A * | 5/1998 | Macauley et al. | 428/36.4 |
| D425,793 | S | 5/2000 | Walker | |
| D453,004 | S | 1/2002 | Hirata | |
| D457,067 | S | 5/2002 | Martynov et al. | |
| D466,813 | S | 12/2002 | Thierjung et al. | |
| D468,213 | S | 1/2003 | Moore et al. | |
| D468,645 | S | 1/2003 | Nelson et al. | |
| D472,815 | S | 4/2003 | Zhang et al. | |
| 6,749,075 | B2 * | 6/2004 | Bourque et al. | 215/384 |
| 6,779,673 | B2 * | 8/2004 | Melrose et al. | 215/381 |
| 6,837,390 | B2 * | 1/2005 | Lane et al. | 215/381 |
| 7,014,056 | B2 * | 3/2006 | Trude | 215/381 |
| 7,097,061 | B2 * | 8/2006 | Simpson et al. | 215/396 |
| D530,212 | S | 10/2006 | Darr et al. | |
| D545,198 | S | 6/2007 | Hatcher et al. | |
| D547,195 | S | 7/2007 | Yourist et al. | |
| D547,665 | S | 7/2007 | Lepoitevin | |
| D548,087 | S | 8/2007 | Wolf | |
| D605,054 | S | 12/2009 | Ungrady | |
| D610,015 | S | 2/2010 | Yourist et al. | |
| D610,016 | S * | 2/2010 | Yourist et al. | D9/538 |
| D610,017 | S | 2/2010 | Yourist et al. | |
| 7,748,551 | B2 * | 7/2010 | Gatewood et al. | 215/381 |
| D623,529 | S | 9/2010 | Yourist et al. | |
| D623,530 | S | 9/2010 | Ungrady et al. | |

(Continued)

*Primary Examiner* — Sue Weaver
(74) *Attorney, Agent, or Firm* — The Patentwise Group, LLC

(57) ABSTRACT

A hot fill type plastic container includes a bottom portion and a main body having a vacuum uptake portion that is bounded by upper and lower horizontal grooves. The vacuum uptake portion has four side panel portions, and each of the side panel portions has at least one vertical groove defined therein. The vertical grooves are substantially centered with respect to the side panel portions. No surface features other than the vertical grooves are included on the side panel portions. The main body further includes upper and lower round portions that are respectively positioned above and below the vacuum uptake portion.

26 Claims, 4 Drawing Sheets

U.S. PATENT DOCUMENTS

| | | | | |
|---|---|---|---|---|
| D623,531 | S | 9/2010 | Ungrady et al. | |
| D624,427 | S | 9/2010 | Yourist et al. | |
| D652,731 | S * | 1/2012 | Pritchett et al. | D9/538 |
| 2004/0016716 | A1 | 1/2004 | Melrose et al. | |
| 2004/0129598 | A1 * | 7/2004 | Zhang et al. | 206/524.8 |
| 2006/0175284 | A1 * | 8/2006 | Noll et al. | 215/382 |
| 2007/0199918 | A1 * | 8/2007 | Sabold | 215/383 |
| 2008/0035636 | A1 * | 2/2008 | Grant et al. | 220/23.4 |
| 2009/0095702 | A1 * | 4/2009 | Ungrady et al. | 215/383 |
| 2009/0184127 | A1 * | 7/2009 | Mooney | 220/669 |
| 2010/0155360 | A1 * | 6/2010 | Mast et al. | 215/383 |
| 2010/0320218 | A1 | 12/2010 | Tanaka | |

* cited by examiner

HOT FILL TYPE PLASTIC CONTAINER

BACKGROUND OF THE INVENTION

1. Field of the Invention

This invention relates generally to the field of packaging, and more specifically to the field of hot fill type plastic containers.

2. Description of the Related Technology

Hot fill containers are designed to be used with the conventional hot fill process in which a liquid product such as fruit juice is introduced into the container while warm or hot, as appropriate, for sanitary packaging of the product.

Most hot fill type containers are fabricated from polyethylene terephthalate, which is otherwise known as PET. PET possesses excellent characteristics for such containers, but PET resin is relatively expensive. Accordingly, a PET container design that reduces the amount of material that is used without sacrificing performance will provide a significant competitive advantage within the packaging industry.

After filling, such containers undergo significant volumetric shrinkage as a result of the cooling of the product within the sealed container. Hot fill type containers accordingly must be designed to have the capability of accommodating such shrinkage. Typically this has been done by incorporating one or more recessed, concave vacuum panels into the side wall of the container that are designed to flex inwardly as the volume of the product within the container decreases as a result of cooling. In other containers, vacuum uptake is achieved by flat, non-recessed panels that are designed to flex in order to accommodate the volumetric shrinkage.

Ribs or grooves are sometimes provided in order to control the flexure of the side wall during the hot fill process, as well as for imparting rigidity to the container when it is being gripped by a consumer. In certain containers that have flat vacuum panels, the presence of horizontal ribs has been found to contribute to creasing of the vacuum panel during vacuum uptake conditions.

A need has existed for an improved hot fill container design that provides adequate vacuum uptake during the hot fill process, is resistant to creasing during vacuum uptake conditions and that imparts sufficient rigidity to permit a consumer to grip the container without excessive sidewall deflection.

SUMMARY OF THE INVENTION

Accordingly, it is an object of the invention to provide an improved hot fill container design that provides adequate vacuum uptake during the hot fill process, is resistant to creasing during vacuum uptake conditions and that imparts sufficient rigidity to permit a consumer to comfortably grip the container without excessive sidewall deflection.

In order to achieve the above and other objects of the invention, a hot fill type plastic container according to a first aspect of the invention includes a bottom portion and a main body having a vacuum uptake portion that is bounded by an upper horizontal groove and a lower horizontal groove. The vacuum uptake portion has four side panel portions, and each of the side panel portions has at least one vertical groove defined therein. Moreover, the vertical grooves are substantially centered with respect to the side panel portion.

A hot fill type plastic container according to a second aspect of the invention includes a bottom portion and a main body having a vacuum uptake portion. The vacuum uptake portion has four side panel portions. Each of the side panel portions has two vertical grooves defined therein. The two vertical grooves are evenly spaced across a width of the side panel portion. Each of the vertical grooves has a length to width ratio of at least 5:1, and there are no surface features other than the vertical grooves on the side panel portions.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
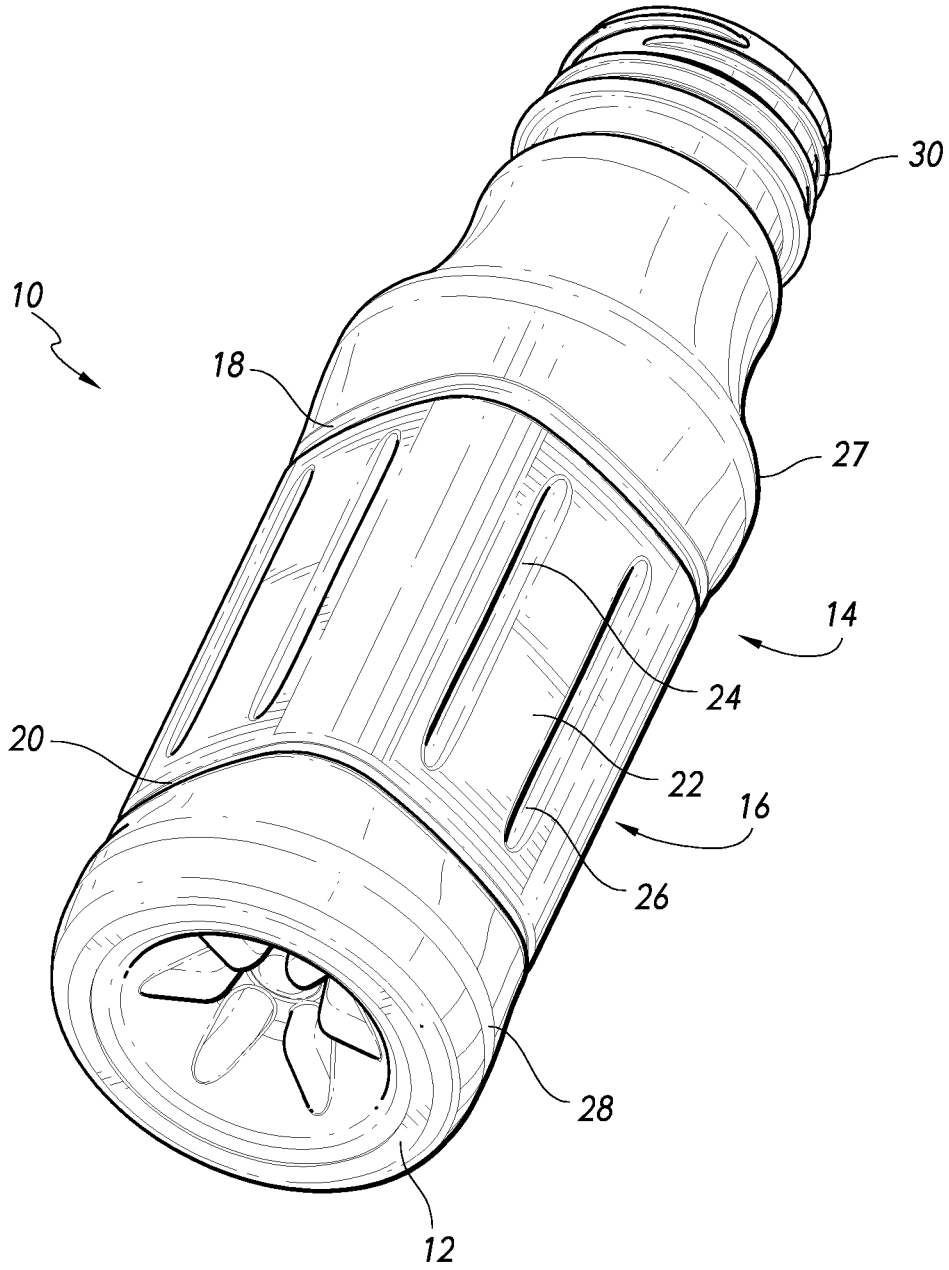
FIG. 1 is a perspective view depicting a plastic container that is constructed according to a preferred embodiment of the invention.

Referring now to the drawings, wherein like reference numerals designate corresponding structure throughout the views, and referring in particular to FIG. 1, a hot fill type plastic container 10 that is constructed according to a preferred embodiment of the invention is preferably fabricated from a plastic material such as polyethylene terephthalate using the reheat stretch blow molding process.

Plastic container 10 includes a bottom portion 12 and a main body 14, which has a vacuum uptake portion 16 defined between an upper horizontal groove 18 and a lower horizontal groove 20. Plastic container 10 further includes a threaded finish portion 30 having an opening defined therein that is in communication with an interior space of the plastic container 10.

The vacuum uptake portion 16 preferably has four side panel portions 22, each of which has at least one vertical groove defined therein. In the preferred embodiment, each of the side panel portions 22 has two vertical grooves 24, 26 defined therein, and the group of two vertical grooves 24, 26 is preferably substantially centered with respect to the side panel portion 22. In the preferred embodiment, there are no surface features other than vertical grooves 24, 26 provided on the side panel portions 22. In other words, there are no recesses or horizontal ribs defined in any of the side panel portions 22.

Figure 3:
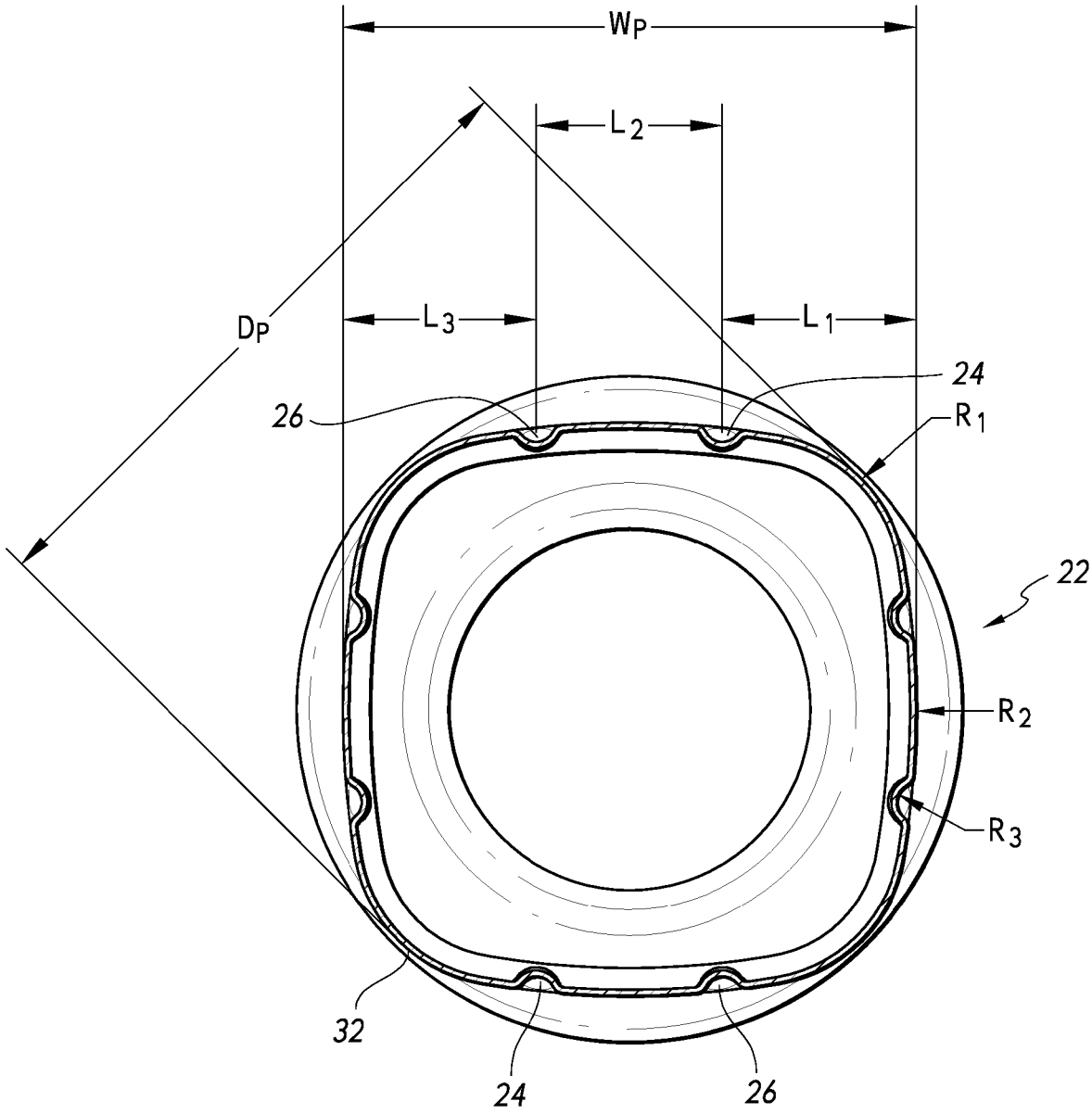
FIG. 3 is a cross-sectional view taken along lines 3-3 in FIG. 1.

The vertical grooves 24, 26 are preferably spaced apart substantially evenly across a width of the side panel portion 22. Referring briefly to FIG. 3, it will be seen that each of the side panel portions 22 has a maximum width $W_P$ and a maximum diameter $D_P$. Opposing side panel portions 22 are preferably substantially symmetrical and identical in size and in shape. More preferably, all of the side panel portions 22 are substantially identical in size and in shape.

The side panel portions 22 are substantially flat, meaning that any curvature is slight and there are no significant recesses or projections other than the grooves 24, 26 defined in the side panel portions 22. In the preferred embodiment the side panel portions 22 are shaped so as to be slightly convex facing outwardly, having a radius of curvature $R_2$, which is best shown in FIG. 3.

Preferably, the radius of curvature $R_2$ is at least 1.0 inch, more preferably at least 1.75 inch, and most preferably at least 2.5 inch. A ratio $R_2/W_P$ of the radius of curvature of the side panel portions 22 to the maximum width of the side panel portion 22 is preferably at least about 0.75, more preferably at least about 1.0 and most preferably at least about 1.5.

Each of the grooves 24, 26 is preferably concave and has an average radius of curvature $R_3$ that is preferably substantially within a range of about 0.04 inch to about 0.09 inch, and more preferably substantially within a range of about 0.05 inch to about 0.08 inch.

As FIG. 3 shows, groove 24 is preferably spaced laterally a first distance $L_1$ from the end of the side panel portion 22. The grooves 24, 26 are preferably spaced laterally with respect to each other by a second distance $L_2$, and groove 26 is preferably spaced laterally a third distance $L_3$ from the opposite end of the side panel portion 22. Preferably, the three distances $L_1$, $L_2$ and $L_3$ are substantially equal to each other.

Each of the vertical grooves 24, 26 preferably has a length to width ratio that is at least 5:1, and more preferably that is at least 10:1.

The vacuum uptake portion 16 is further preferably shaped so that a rounded corner 32 is formed between adjacent side panel portions 22. Each rounded corner 32 is preferably convexly curved, having a radius $R_1$. Preferably, a percentage ratio $R_1/W_P$ of the curvature of the rounded corners 32 to the maximum width $W_P$ of the side panel portions 22 is substantially within a range of about 10% to about 40%, more preferably substantially within a range of about 15% to about 35% and most preferably substantially within a range of about 20% to about 30%.

Figure 2:
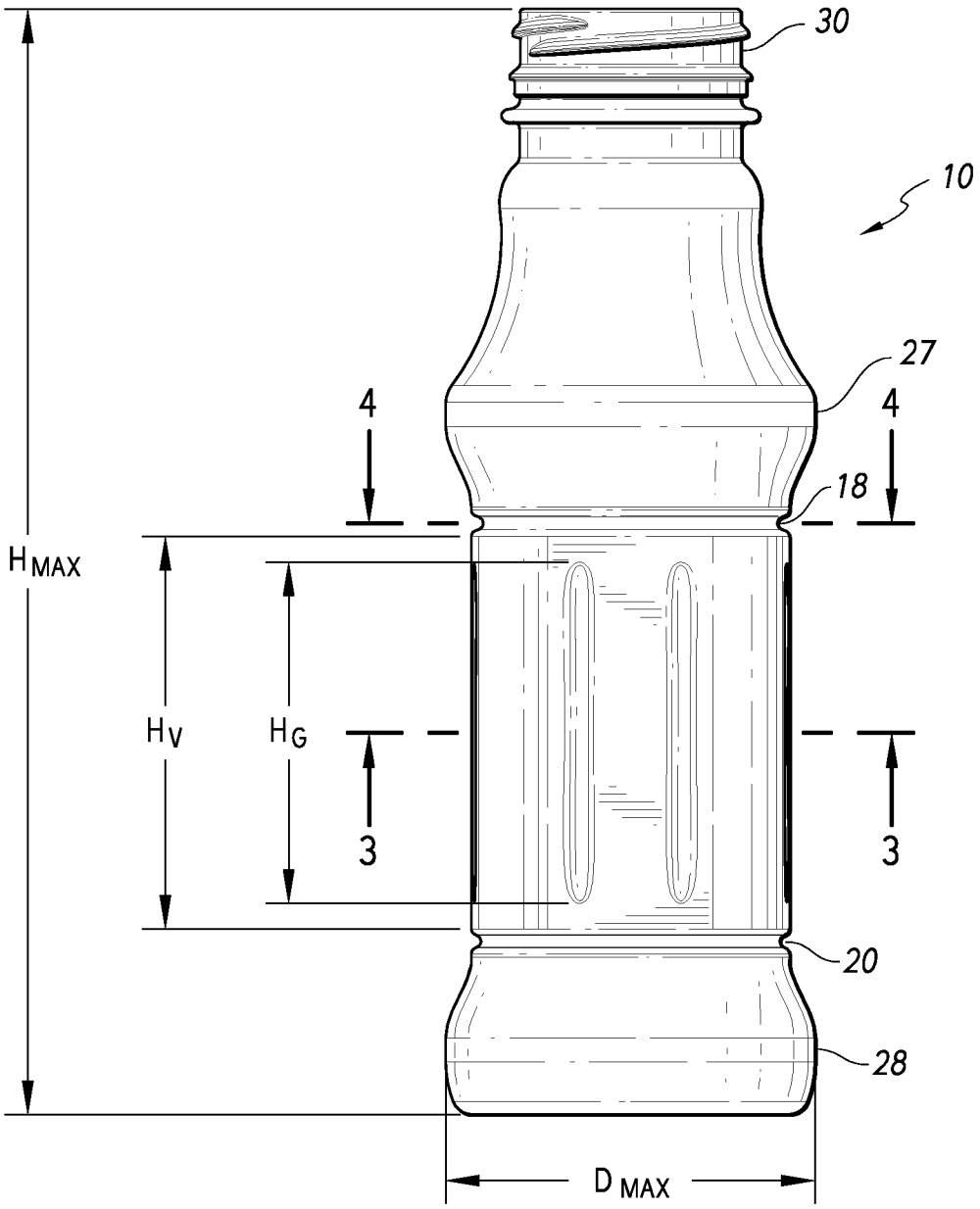
FIG. 2 is a side elevational view of the plastic container shown in FIG. 1.

As is best shown in FIG. 2, the vacuum uptake portion 16 has a first height $H_V$, and at least one of the vertical grooves 24, 26 has a second height $H_G$. A percentage ratio of the second height $H_G$ to the first height $H_V$ is preferably substantially within a range of about 50% to about 98%, more preferably substantially within a range of about 60% to about 95% and most preferably within a range of about 70% of about 90%.

Plastic container 10 also defines a maximum vertical dimension $H_{MAX}$, as is best shown in FIG. 2. A percentage ratio of the first height $H_V$ to the maximum vertical dimension $H_{MAX}$ is preferably substantially within a range of about 20% of that 60%, more preferably substantially within a range of about 25% to about 50% and most preferably substantially within a range of about 30% to about 40%.

The main body 14 also preferably includes upper and lower round portions 27, 28 that are respectively positioned above and below the vacuum uptake portion 16. Each of the upper and lower round portions 27, 28 has an outer surface that is substantially circular when viewed in transverse cross-section. Container 10 is thus what is typically referred to in the industry as a round container.

Figure 4:
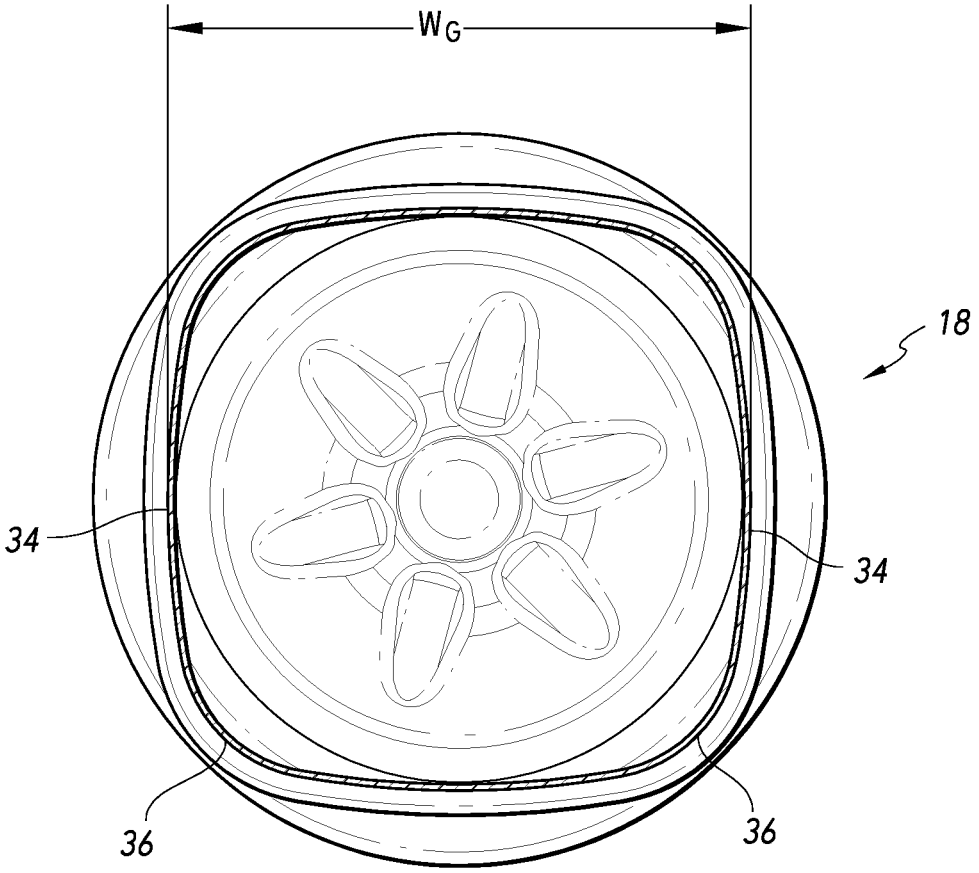
FIG. 4 is a cross-sectional view taken along lines 4-4 in FIG. 1.

Referring to FIG. 4, which is a transverse cross-sectional depiction taken through the upper horizontal groove 18, it will be seen that the upper horizontal groove has four sides 34 and four corners 36. The four corners 36 are preferably rounded, as is shown in FIG. 4. In the preferred embodiment, the lower horizontal groove 20 has a similar appearance in transverse cross-section to the upper horizontal groove 18.

A plastic container is described herein has been found to possess superior resistance to creasing during vacuum uptake conditions with respect to conventional hot fill plastic containers.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A hot fill type plastic container, comprising:

a bottom portion; and a main body having a vacuum uptake portion that is bounded by an upper horizontal groove and a lower horizontal groove, the vacuum uptake portion having four side panel portions, each of the side panel portions being substantially flat, with rounded corners defined between adjacent side panel portions;

wherein at least one of the side panel portions has at least two vertical grooves, and wherein the two vertical grooves are spaced apart substantially evenly on the side panel portion, and wherein each of the side panel portions has no recesses or projections defined therein other than the vertical grooves.

2. A hot fill type plastic container according to claim 1, wherein the vacuum uptake portion has a first height and at least one of the two vertical grooves has a second height, and wherein a ratio of the second height to the first height is substantially within a range of about 50% to about 98%.

3. A hot fill type plastic container according to claim 2, wherein the ratio of the second height to the first height is substantially within a range of about 60% to about 95%.

4. A hot fill type plastic container according to claim 3, wherein the ratio of the second height to the first height is substantially within a range of about 70% to about 90%.

5. A hot fill type plastic container according to claim 1, wherein the container has a maximum vertical dimension and the vacuum uptake portion has a first height, and wherein a ratio of the first height to the maximum vertical dimension is substantially within a range of about 20% to about 60%.

6. A hot fill type plastic container according to claim 5, wherein the ratio of the first height to the maximum vertical dimension is substantially within a range of about 25% to about 50%.

7. A hot fill type plastic container according to claim 6, wherein the ratio of the first height to the maximum vertical dimension is substantially within a range of about 30% to about 40%.

8. A hot fill type plastic container according to claim 1, wherein the at least two vertical grooves consist of two vertical grooves, and wherein the two vertical grooves are spaced apart substantially evenly on the side panel portion.

9. A hot fill type plastic container according to claim 1, wherein the main body further includes upper and lower round portions that are respectively positioned above and below the vacuum uptake portion, and wherein both of the upper and lower round portions have an outer surface that is substantially circular when viewed in transverse cross-section.

10. A hot fill type plastic container according to claim 1, wherein at least one of the upper horizontal groove and the lower horizontal groove has four sides and four corners when viewed in transverse cross-section.

11. A hot fill type plastic container according to claim 10, wherein both the upper horizontal groove and the lower horizontal groove have four sides and four corners when viewed in transverse cross-section.

12. A hot fill type plastic container according to claim 1, wherein the main body portion is fabricated from a material comprising polyethylene terephthalate.

13. A hot fill type plastic container according to claim 1, wherein at least one of the at least two vertical grooves has a length to width ratio of at least 5:1.

14. A hot fill type plastic container according to claim 13, wherein at least one of the at least two vertical grooves has a length to width ratio of at least 10:1.

15. A hot fill type plastic container, comprising:

a bottom portion;

a main body having a vacuum uptake portion that is bounded by an upper horizontal groove and a lower horizontal groove, the vacuum uptake portion having four side panel portions, with each of the side panel portions being substantially flat, and wherein rounded corners are defined between adjacent side panel portions, and wherein opposing side panel portions each have at least two vertical grooves, and wherein the two vertical grooves are spaced apart substantially evenly on the side panel portion; and the vertical grooves are substantially centered with respect to the side panel portion; and wherein the opposing side panel portions contain no significant surface features other than the vertical grooves.

16. A hot fill type plastic container according to claim 15, wherein the vacuum uptake portion has a first height and at least one of the vertical grooves has a second height, and wherein a ratio of the second height to the first height is substantially within a range of about 50% to about 98%.

17. A hot fill type plastic container according to claim 16, wherein the ratio of the second height to the first height is substantially within a range of about 60% to about 95%.

18. A hot fill type plastic container according to claim 15, wherein the container has a maximum vertical dimension and the vacuum uptake portion has a first height, and wherein a ratio of the first height to the maximum vertical dimension is substantially within a range of about 20% to about 60%.

19. A hot fill type plastic container according to claim 18, wherein the ratio of the first height to the maximum vertical dimension is substantially within a range of about 25% to about 50%.

20. A hot fill type plastic container according to claim 15, wherein the at least two vertical groves on each of the side panel portions consist of two vertical grooves, and wherein the two vertical grooves are spaced apart substantially evenly on the side panel portion.

21. A hot fill type plastic container according to claim 15, wherein the main body further includes upper and lower round portions that are respectively positioned above and below the vacuum uptake portion, and wherein both of the upper and lower round portions have an outer surface that is substantially circular when viewed in transverse cross-section.

22. A hot fill type plastic container according to claim 15, wherein at least one of the upper horizontal groove and the lower horizontal groove has four sides and four corners when viewed in transverse cross-section.

23. A hot fill type plastic container according to claim 22, wherein both the upper horizontal groove and the lower horizontal groove have four sides and four corners when viewed in transverse cross-section.

24. A hot fill type plastic container according to claim 15, wherein the main body portion is fabricated from a material comprising polyethylene terephthalate.

25. A hot fill type plastic container according to claim 15, wherein at least one of the at least two vertical grooves has a length to width ratio of at least 5:1.

26. A hot fill type plastic container according to claim 25, wherein at least one of the at least two vertical grooves has a length to width ratio of at least 10:1.

* * * * *